US007006057B2

(12) United States Patent
Jin et al.

(10) Patent No.: US 7,006,057 B2
(45) Date of Patent: Feb. 28, 2006

(54) APPARATUS AND METHOD FOR DRIVING SCAN ELECTRODES OF ALTERNATING CURRENT PLASMA DISPLAY PANEL

(75) Inventors: Kwang-Ho Jin, Seoul (KR); Sung-Un Kim, Ahsan (KR); Jea-Hyuk Lim, Cheonan (KR)

(73) Assignee: Samsung Electronics Co., Ltd., Suwon (KR)

( * ) Notice: Subject to any disclaimer, the term of this patent is extended or adjusted under 35 U.S.C. 154(b) by 130 days.

(21) Appl. No.: 10/189,376

(22) Filed: Jul. 8, 2002

(65) Prior Publication Data

US 2003/0025654 A1 Feb. 6, 2003

(30) Foreign Application Priority Data

Aug. 6, 2001 (KR) ..... 2001-47312

(51) Int. Cl.
*G09G 3/28* (2006.01)

(52) U.S. Cl. ..... 345/60; 345/66

(58) Field of Classification Search ..... 345/60, 345/62, 63, 66–68; 313/582–587; 315/169.4
See application file for complete search history.

(56) References Cited

U.S. PATENT DOCUMENTS 6,628,087 B1 * 9/2003 Roh et al. ..... 315/169.3
6,653,795 B1 * 11/2003 Kang et al. ..... 315/169.3
6,686,912 B1 * 2/2004 Kishi et al. ..... 345/211

* cited by examiner

*Primary Examiner*—Jimmy H. Nguyen
(74) *Attorney, Agent, or Firm*—HC Park & Associates PLC

(57) ABSTRACT

A scan electrode driving apparatus of an AC PDP including a plurality of address electrodes and a plurality of scan electrodes and sustain electrodes alternately arranged to make pairs with each other, and having a panel capacitor between the scan electrodes and the sustain electrodes, includes a power recovery unit for supplying power to a panel in order to apply waveforms for sustain-discharge and recovering and re-using the supplied power, a ramp waveform applier for supplying a pulse signal for resetting the states of the respective discharge cells on the basis of the power received from the power recovery unit, and a scan pulse generator for accumulating a wall charge into the addressed discharge cells.

15 Claims, 8 Drawing Sheets

APPARATUS AND METHOD FOR DRIVING SCAN ELECTRODES OF ALTERNATING CURRENT PLASMA DISPLAY PANEL

BACKGROUND OF THE INVENTION (a) Field of the Invention

The present invention relates to an alternating current (AC) plasma display panel (PDP). More specifically, the present invention relates to an apparatus and a method for driving scan electrodes of the AC PDP, which are capable of reducing the number of driving switches in a scan Y electrode driving circuit, to thus set the path of the flow of current between the PDP and the driving circuit.

(b) Description of the Related Art

In general, a plasma display panel (PDP) is a flat panel display for displaying characters or images using plasma gas discharges. Pixels ranging from hundreds of thousands to more than millions are arranged in the form of a matrix depending on the PDP size. PDPs are classified into a direct current (DC) PDP and an alternating current (AC) PDP based on the waveform shape of driving voltages and the discharge cell structure.

The most significant difference between the DC PDP and the AC PDP is that, in the DC PDP, the current directly flows in the discharge area while applying voltages, because electrodes are exposed to the discharge spaces. Therefore, a resistor that restricts the current must be used outside of the DC PDP. On the other hand, in the AC PDP, the current is restricted because capacitance is natually formed by the dielectric layer covering the electrodes. The AC PDP has a longer life than the DC PDP because the electrodes are protected against the ion shocks generated by the discharge. A memory characteristic is one of the important characteristics of the AC PDP and it is implemented by the capacity due to the dielectric layer covering the electrodes.

According to the light emission principle of the AC PDP, discharge occurs because an electric potential difference in the form of a pulse signal is formed in common electrodes (X electrodes) and scan electrodes (Y electrodes). At this time, vacuum ultraviolet (UV) rays generated in the discharge process excite red R, green G, and blue B fluorescent bodies. The respective fluorescent bodies emit light due to light combination. The discharge is affected by various parameters such as the kind and the pressure of the discharge gas inside the PDP, the secondary electron emission characteristic of an MgO protecting film, and the structures and the driving conditions of the electrodes.

In the AC PDP, because the common electrodes (the X electrodes) and the scan electrodes (the Y electrodes) for sustaining discharge operate as capacitive load, capacitance Cp is formed with respect to the X electrode and the Y electrodes. Reactive power other than power for discharge is necessary in order to apply waveforms for the sustain-discharge. A circuit for recovering and re-using the reactive power is referred to as a sustain-discharge circuit or a power recovery circuit.

FIG. 1 shows the arrangement of the electrodes of a common PDP.

The electrodes are in the matrix form of m columns and n rows. Address electrodes A1 through Am are arranged in the column direction, and scan electrodes SCN1 through SCNn and sustain electrodes SUS1 through SUSn of n rows are arranged in the row direction. The discharge area is positioned where the address electrodes and a pair of the scan electrode and the sustain electrode cross each other, and forms a discharge cell.

A conventional Y electrode driving circuit includes a power recovery unit, a reset pulse supplier, a scan buffer IC, and a scan pulse supplier.

The power recovery unit supplies power to a panel capacitor through switching operations based on the operation sequence, and recovers power after the discharge. The reset pulse supplier generates a reset pulse that resets each of the discharge cells. The scan buffer IC stores a scan pulse signal and outputs it according to predetermined timing. The scan pulse supplier selects the discharge cells to be turned on and the discharge cells not to be turned on.

According to the method for driving the panel by the Y electrode driving circuit, a frame comprises n sub-fields. Each sub-field includes a reset period, a scan period, a sustain period, and an erase period.

In the reset period, the address electrodes A1 through Am and the sustain electrodes SUS1 through SUSn are sustained at 0 V in the first half thereof. A ramp voltage that slowly increases from a voltage of no higher than a discharge starting voltage toward a voltage higher than the discharge starting voltage with respect to the sustain electrodes, is applied to the scan electrodes SCN1 through SCNn. In the latter half of the reset period, a ramp voltage that slowly decreases from the voltage of no higher than the discharge starting voltage of the sustain electrodes toward 0 V is applied to the scan electrodes.

In the scan period, all the Y electrodes are sustained at a predetermined voltage. An address voltage and a scan pulse voltage (0 V) are simultaneously applied to the address electrode and the Y electrode corresponding to the discharge cell to be displayed in the first row, respectively, to accumulate wall charges in the selected cells.

In the sustain period, a sustain pulse is applied to all the Y electrode and the X electrode to keep the sustain-discharge in the discharge cells according to the gray scales to be displayed.

In the erase period, an erase pulse is applied to all the X electrodes to stop the sustain-discharge.

In the driving circuit, to which such a panel driving method is applied, a plurality of switches are provided to the reset pulse supplier of a Y electrode driving circuit for generating a ramp waveform to be applied in the reset period. The switches open the path of the current that flows between the driving circuit and the panel, and they separate the power recovery unit from the scan pulse supplier when a reset waveform is generated.

In the conventional Y electrode driving circuit, switches play an important role in forming the circuit. However, a number of switches increase the manufacturing costs of the driving circuit. Also, the switches are located in the main current path, which is not desirable for the output characteristics of the respective driving signals.

SUMMARY OF THE INVENTION

It is an object of the present invention to provide a scan electrode driving apparatus for generating a reset waveform that is the operation waveform of a reset period, by removing the switches that exist on the main path through which current flows.

In one aspect of the present invention, a scan electrode driving apparatus of an alternating current (AC) plasma display panel (PDP) comprising a plurality of address electrodes and a plurality of scan electrodes and sustain electrodes arranged in a zigzag pattern so as to make pairs with each other, and having a panel capacitor between the scan electrodes and the sustain electrodes, comprises: a power recovery unit for supplying power to a panel in order to apply waveforms for sustain-discharge, and recovering and re-using the supplied power; a ramp waveform applier for supplying a pulse signal for resetting states of respective discharge cells on the basis of the power received from the power recovery unit during a reset period; and a scan pulse generator for accumulating a wall charge into addressed discharge cells during a scan period, wherein the ramp waveform applier separates a first current transmission path for transmitting a pulse signal for resetting the states of the respective cells to the panel capacitor from a second current transmission for recovering the power from the panel capacitor.

In another aspect of the present invention, a method for driving a PDP comprising a plurality of address electrodes and a plurality of scan electrodes and sustain electrodes arranged in a zigzag pattern so as to make pairs with each other, and having a panel capacitor between the scan electrodes and the sustain electrodes, comprises the steps of: (a) resetting charge distribution states of discharge cells formed by the address electrodes, the scan electrodes, and the sustain electrodes; (b) determining whether to turn the discharge cells on or off and addressing the discharge cells; and (c) sustain-discharging the addressed discharge cells, wherein the step (a) comprises the steps of: supplying a reset voltage to the panel capacitor; and conducting first and second switches electrically coupled to the panel capacitor through first and second paths different from the path through which the reset voltage is supplied to the panel capacitor to thus reduce the reset voltage supplied to the panel capacitor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only preferred embodiments of the invention has been shown and described, simply by illustrating the best mode contemplated by the inventor(s) of carrying out the invention. As will be realized, the invention can be modified in various obvious respects, all without departing from the invention. Accordingly, the drawings and description are to be regarded as illustrative in nature, and not restrictive.

Figure 1:
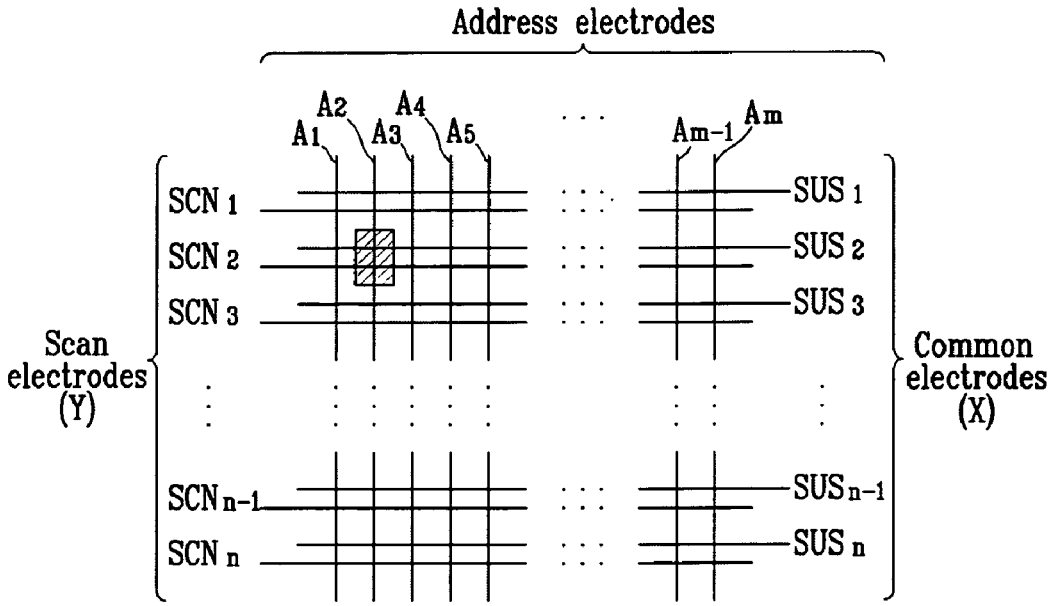
FIG. 1 shows the arrangement of the electrodes of a general plasma display panel (PDP).
Figure 2:
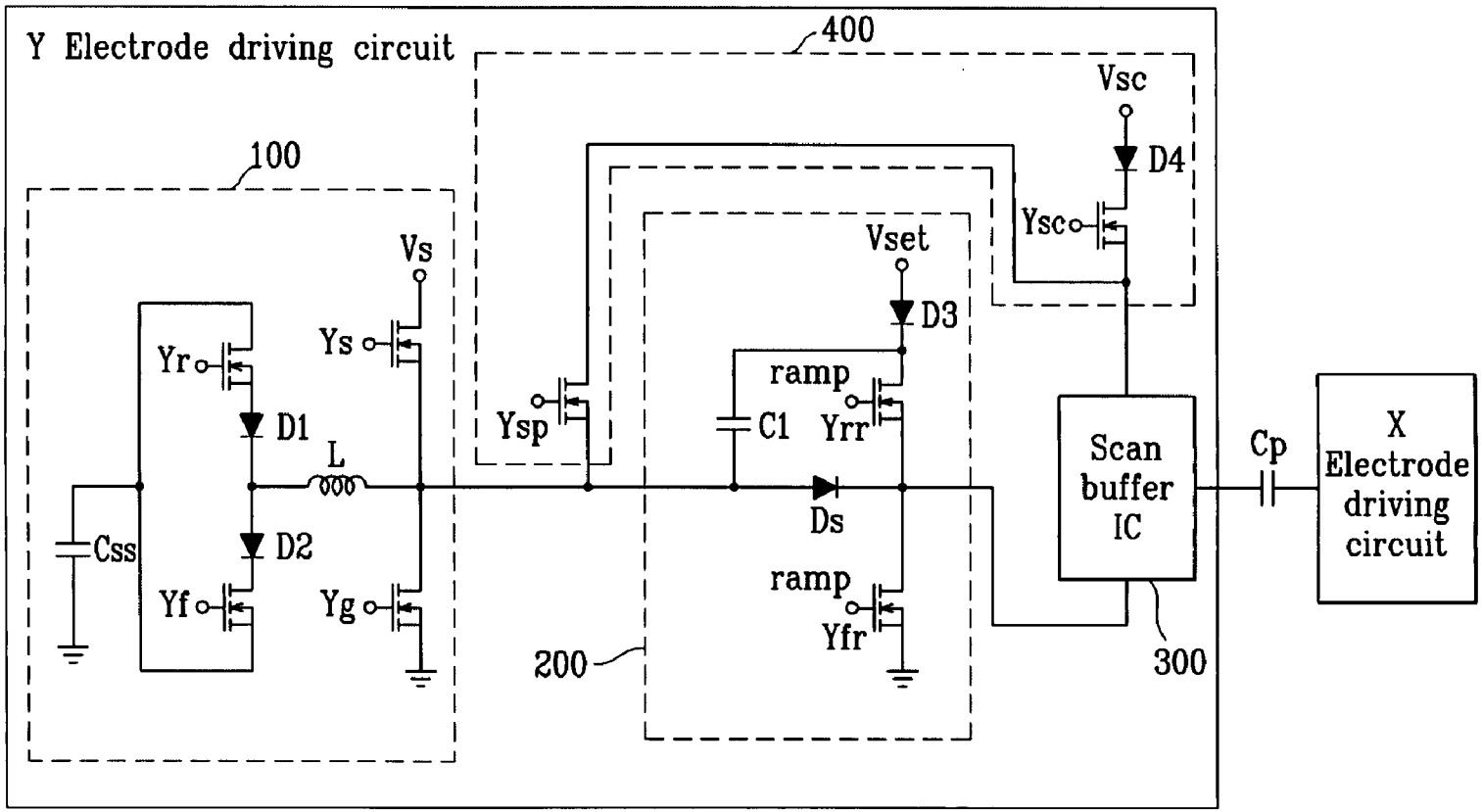
FIG. 2 is a circuit diagram showing the Y electrode driving circuit of an alternating current (AC) PDP according to an embodiment of the present invention.

FIG. 2 is a circuit diagram showing the Y electrode driving circuit of an AC PDP according to an embodiment of the present invention.

As shown in FIG. 2, the Y electrode driving circuit of the AC PDP according to the embodiment of the present invention includes a power recovery unit 100 for supplying power to a panel Cp in order to apply waveforms for sustain-discharge and recovering and re-using the supplied power, a reset pulse supplier 200 for supplying a pulse signal for resetting the states of the respective discharge cells to the discharge cells on the basis of the power received from the power recovery unit 100 so that an addressing operation is smoothly performed, a scan buffer IC 300 for storing a reset signal for resetting the states of the respective discharge cells and a scan signal for accumulating wall charge into the discharge cells and outputting stored signals according to predetermined timing, and a scan pulse supplier 400 for accumulating the wall charge into the addressed discharge cells.

The operation of the Y electrode driving circuit of the AC PDP according to the embodiment of the present invention will now be described in detail with reference to the attached drawings.

Figure 3:
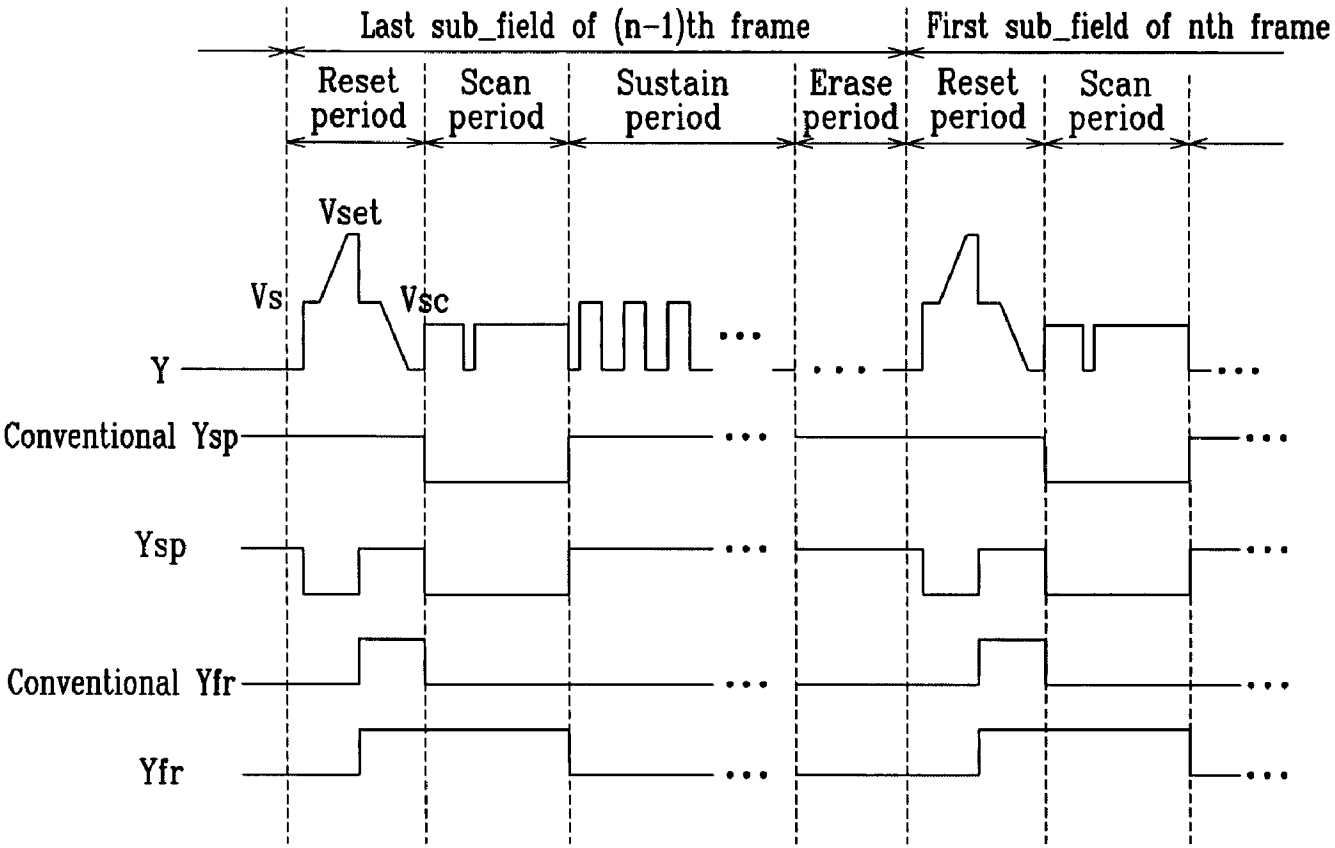
FIG. 3 shows driving waveforms according to the embodiment of the present invention.

FIG. 3 shows driving waveforms according to the embodiment of the present invention.

As shown in FIG. 3, in a reset stage, the voltage of both ends of the panel Cp is sustained to be 0 V because a switch Yg is made to conduct right before a switch Yr is made to conduct. A power recovery capacitor Css is previously charged by a voltage Vs/2 that is half of an externally applied voltage Vs in order to prevent a rush current when the sustain-discharge starts. When the switch Yr starts to be turned on and the switches Ys, Yg, and Yf start to be turned off in a state where the voltage of both ends of the panel Cp is sustained to be 0 V, an LC resonance circuit is formed in the paths of the power recovery capacitor Css, the switch Yr, a diode D1, an inductor L, and a diode Ds. Accordingly, the current flows along the current paths and increases the output voltage at the panel capacitor Cp to a predetermined voltage Vs.

The switches Yr and Ys are turned on and the switches Yf and Yg are turned off. Accordingly, the external by applied voltage Vs flows to the panel Cp through the switch Ys to thus sustain the output voltage of the panel Cp, and the capacitor C1 sustains the voltage difference between the reset pulse voltage Vset and the voltage Vs.

At this time, the switch Yrr is turned on in order to supply a rising ramp waveform. Accordingly, the entire voltage increases to the voltage obtained by adding the external applied voltage Vs to a reset pulse voltage Vset. Accordingly, the entire voltage is the external applied voltage Vs+the reset pulse voltage Vset. At this time, a low level signal is applied to the gates of a switch Ysp and a switch Yfr. Accordingly, the switch Ysp and the switch Yfr are turned off so that the voltage increases. According to the embodiment of the present invention, the externally applied voltage Vs is driven to be 160 V, and because the reset pulse voltage Vset is driven to be 220 V, the final threshold voltage is 160 V+220 V=360 V. However, the present invention is not restricted to the embodiment. A description of general operations of diodes D3 and D4 for letting the current flow in only one direction will be omitted.

As shown in FIG. 3, the conventional driving method turns on the switch Ysp except for the scan period. However, the present invention turns off the switch Ysp in a predetermined first period, when the rising ramp waveform is applied. Accordingly, the present invention separates the power recovery unit 100 from the scan pulse supplier 400 for such period.

In the second half of the reset period, the switches Ysp and Yfr are turned on. Accordingly, the driving voltage that increased up to the reset pulse voltage Vset now slowly decreases.

When the scan period starts, the low level signal is applied to the gate of the switch Ysp. The high level signal is continuously applied to the gate of the switch Yfr while the scan pulse that operates during the scan period is applied to the switch Ysc. In the conventional technology, the switch Yfr is turned off while the scan pulse is applied. In the present invention, however, the switch Yfr is continuously turned on. This is because the switch Yfr applies a ground bias to a low side of the scan buffer IC 300 during a scan period. Therefore, the switch Yfr must be turned on during the scan period. It positively affects the characteristics of the scan waveform to bias to the ground using the switch Yfr because the scan period starts right after completing a falling ramp waveform.

When the scan period is completed and the sustain period starts, the switch Ysp is turned on, and the switch Yfr is turned off. At this time, the switch Yf is turned on and the switches Yr, Ys, and Yg are turned off (step 1). Accordingly, the LC resonance circuit is formed due to the paths of the panel capacitor Cp, the switch Ysp, the inductor L, a diode D2, the switch Yf, and the power recovery capacitor Css. Therefore, the current flows through the inductor L and the panel output voltage decreases to 0 V. At this time, the switch Yg is turned on so that the panel output voltage is sustained to be 0 V (step 2). Next, the switches Yf and Yg are turned off and the switch Yr is turned on, so that the LC resonance circuit is formed due to the panel capacitor Cp and the inductor L (step 3). Therefore, the current flows through the inductor L and the panel output voltage increases to Vs. At this time, the switch Ys is turned on so that the panel output voltage is sustained to be Vs (step 4). By the repeating the step 1 to 4, the waveform for the sustain-discharge is formed.

In the erase period, a predetermined erase pulse is applied to all of the X electrodes to stop the sustain-discharge. A description of the operation of the switch during the erase period will be omitted.

Figure 4A:
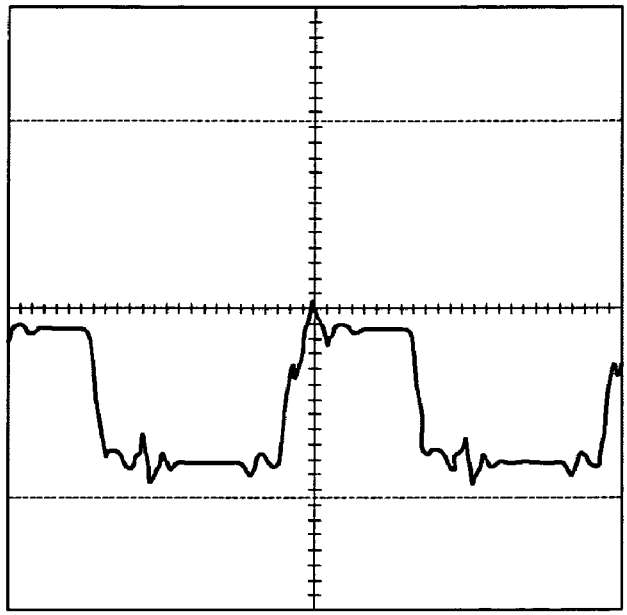
FIGS. 4A and 4B show the sustain-period waveforms of a driving circuit according to the embodiment of the present invention, and allow a comparison of the sustain-period waveforms with each other.
Figure 4B:
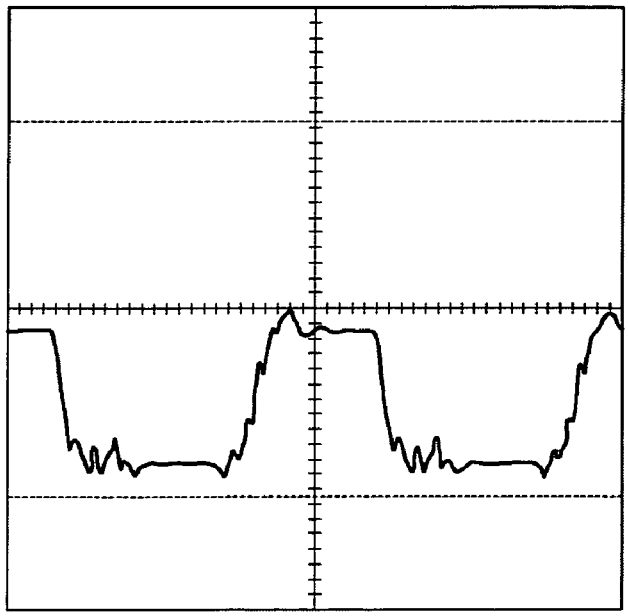

FIGS. 4A and 4B show the sustain-period waveforms of the driving apparatus according to the embodiment of the present invention, and allow comparison of the sustain-period waveforms.

The sustain-pulse waveform during the sustain period will now be described. In the conventional technology, an inner diode generates noises in a pulse when the sustain-pulse waveform rises and falls because the sustain-pulse waveform passes through the inner diode (not shown) of the switch Yp. In the embodiment of the present invention, the sustain-pulse waveform is clearer when the sustain-pulse waveform rises and falls because the sustain-pulse waveform passes through the diode Ds in FIG. 2 when the sustain-pulse waveform is supplied.

Usually, noises are generated because the rising pulse waveform of the sustain-pulse waveform passes through the inner diode of the conventional switch (hereinafter, switch Yp) corresponding to the diode Ds according to the embodiment of the present invention. However, in the present invention, the rising pulse waveform of the sustain-pulse waveform passes through the diode Ds, which has a better current characteristic than the current characteristic of the inner diode of the conventional switch Yp. Also, in the conventional method, when the sustain-pulse waveform falls, the sustain-pulse waveform passes through the switch Yp and the switch Ysp. However, in the present invention, the sustain-pulse waveform passes only through the switch Ysp.

Figure 5A:
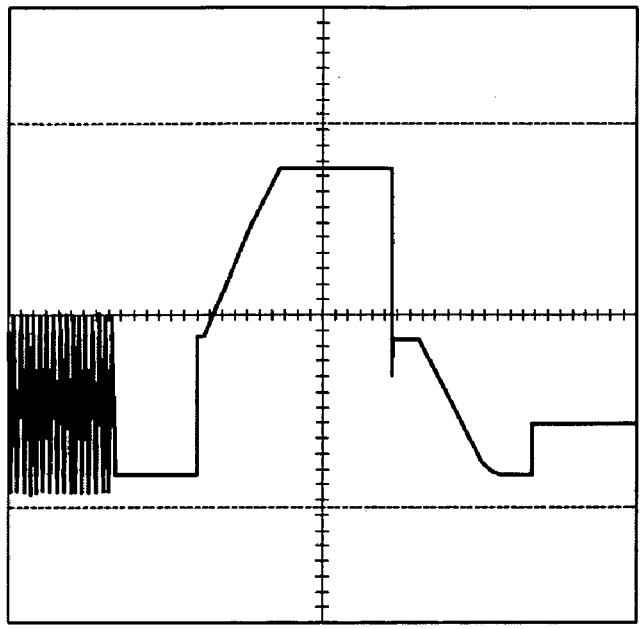
FIG. 5A(Prior Art)
FIGS. 5A and 5B show the reset period waveforms of the driving circuit according to the embodiment of the present invention, and allow a comparison of the reset period waveforms with each other.
Figure 5B:
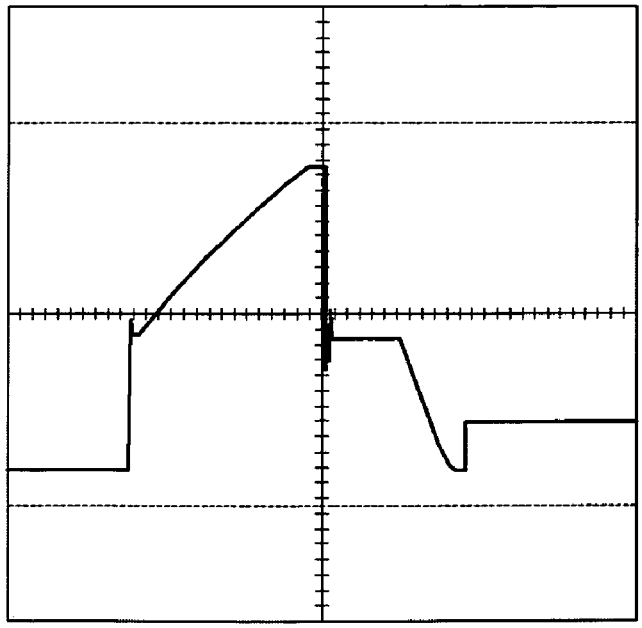

FIG. 5A shows the reset period waveform of the driving apparatus according to the conventional driving method and FIG. 5B shows the same according to the present invention.

As shown in FIG. 5B, the waveform of the reset period according to the embodiment of the present invention is a reset pulse waveform that is similar to the waveform of the conventional reset period as shown in FIG. 5A.

Figure 6A:
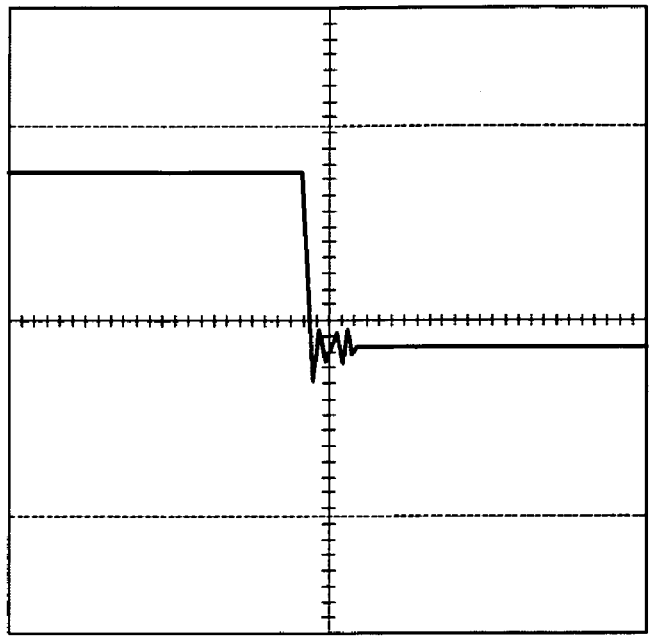
FIG. 6A (Prior Art)
FIGS. 6A and 6B allow a comparison of some measured parts of the reset period waveforms of the driving circuit with each other, according to the embodiment of the present invention.
Figure 6B:
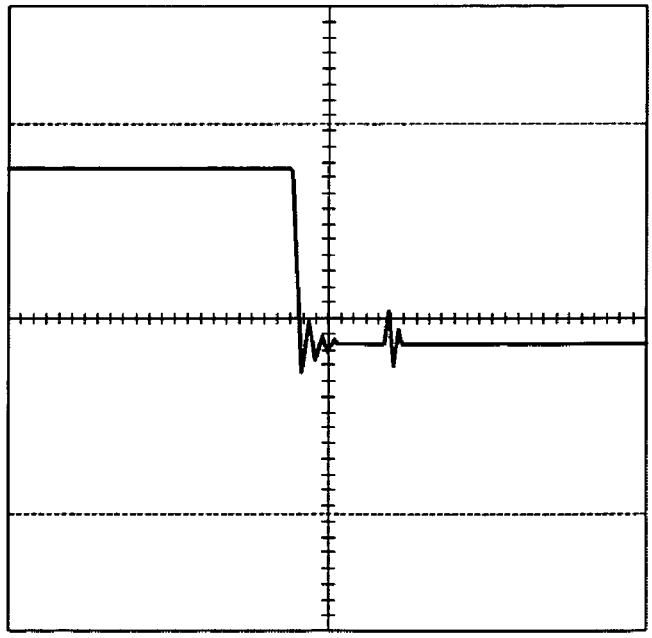

FIG. 6A shows the reset period waveform of the driving apparatus according to the conventional driving method and FIG. 6B shows the same according to the present invention.

As shown in FIG. 6B, the part where a voltage decreases from the voltage Vset to the voltage Vs of the waveform of the reset period according to the embodiment of the present invention is the same as the waveform of FIG. 6A, by the operation of the switch Ysp.

Figure 7A:
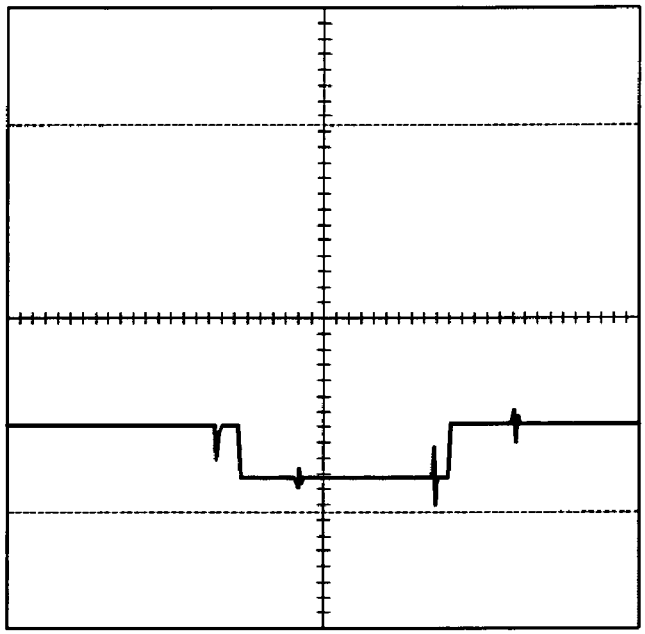
FIG. 7A(Prior Art)
FIGS. 7A and 7B show the scan period waveforms of the driving circuit according to the embodiment of the present invention, and allow a comparison of the scan period waveforms with each other.
Figure 7B:
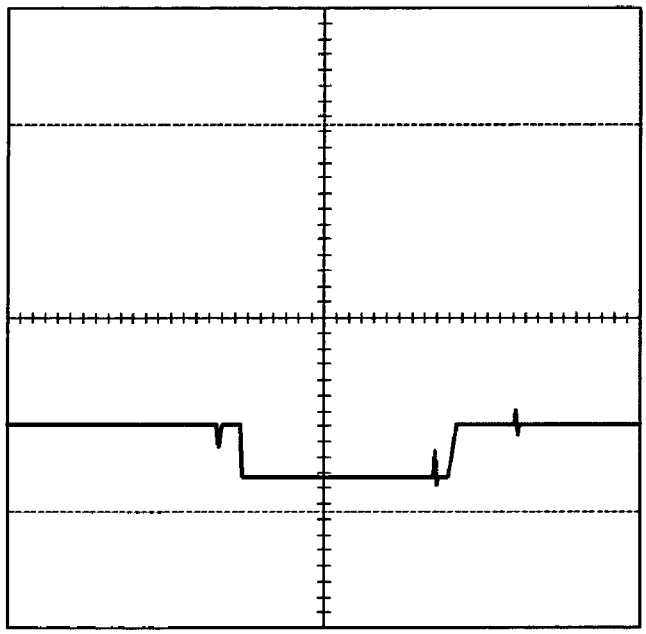

FIG. 7A show the scan period waveforms of the driving apparatus according to the conventional driving method and FIG. 7B show the same according to the embodiment of the present invention.

The switch Yfr in FIG. 2 of the driving apparatus according to the embodiment of the present invention applies the ground bias to the low side of the scan buffer IC 300 during the scan period. The scan waveform according to the embodiment of the present invention is the same as that of FIG. 7A, by the operation of the switch Yfr.

Figure 8:
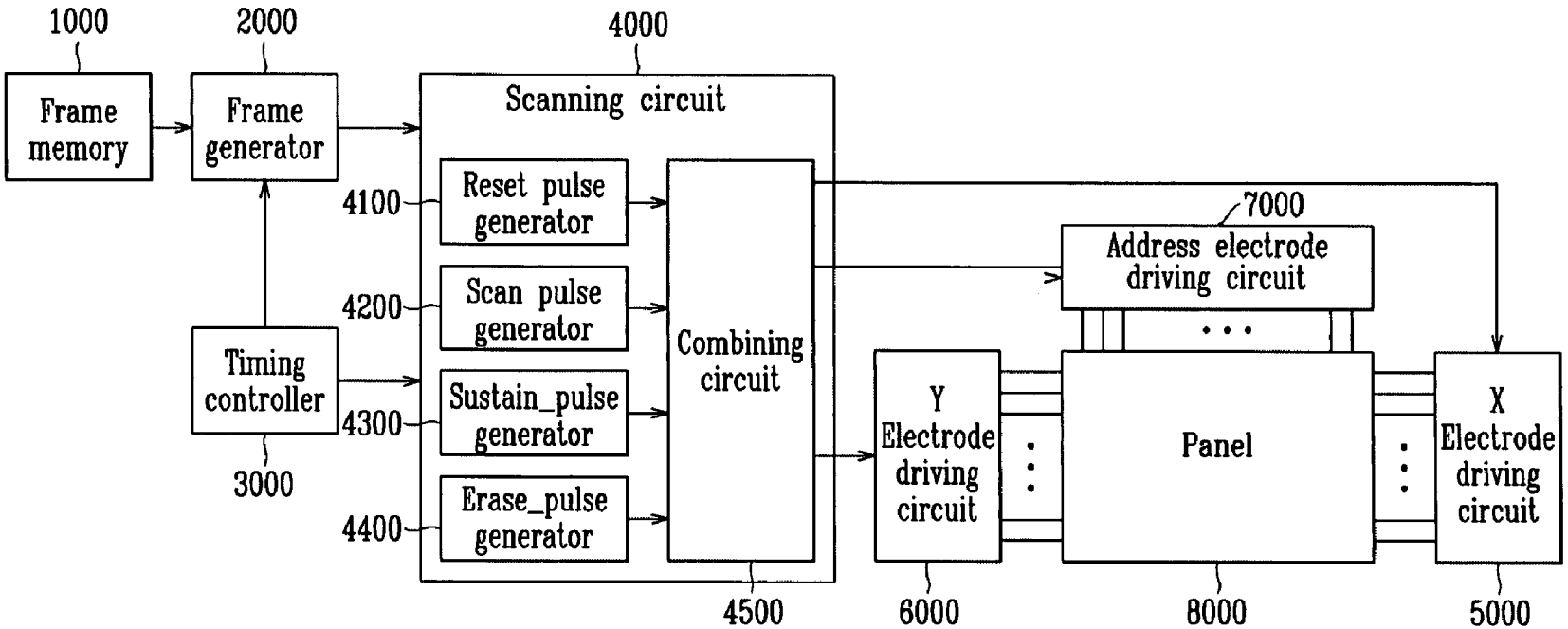
FIG. 8 is a block diagram showing the structure of the PDP including the Y electrode driving circuit according to the embodiment of the present invention.

FIG. 8 is a block diagram showing the structure of the PDP including the Y electrode driving apparatus according to the embodiment of the present invention.

An analog picture signal to be displayed in a panel 8000 is converted into digital data and is recorded in a frame memory 1000. A frame generator 2000 divides the digital data stored in the frame memory 1000 as needed and outputs the divided digital data to a scanning circuit 4000. For example, the panel 8000 divides one frame of pixel data stored in the frame memory 1000 into a plurality of sub-fields according to gray scale levels in order to display gray scales, and outputs the data of the respective sub-fields.

The scanning circuit 4000 has the Y electrode driving circuit 6000 and the X electrode driving circuit 5000 of the panel 8000 that scan the respective discharge cells according to the generated operation signal, and has an address electrode driving circuit 7000 perform addressing so as to turn each discharge cell on or off according to the operation signal.

The scanning circuit 4000 includes a reset pulse generator 4100; a scan pulse generator 4200; a sustain-pulse generator 4300; and an erase-pulse generator 4400 for respectively generating signal waveforms to be applied to the respective electrodes during the reset period, the scan period, the sustain period, and the erase period. That is, the reset pulse generator 4100 generates a reset signal for resetting the states of the respective discharge cells. The scan pulse generator 4200 generates an address signal for selecting the discharge cells to turned on and addresses the selected discharge cells. The sustain-pulse generator 4300 generates a sustain signal for discharging the cells addressed by the scan pulse generator 4200. Finally, the erase-pulse generator 4400 generates an erase signal for erasing the wall charge accumulated by the sustain-discharge. Also, the scanning circuit 4000 includes a combining circuit 4500 that combines the signals and supplies the signals to the respective electrodes. A timing controller 3000 generates various timing signals required for operating the frame generator 2000 and the scanning circuit 4000.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

As mentioned above, in an apparatus and a method for driving the scan electrodes of the AC PDP according to the present invention, it is possible to simplify the structure of the scan electrode driving apparatus and to reduce the manufacturing costs of the scan electrode driving apparatus by removing the switches that exist on the main path, through which the current flows.

Also, it is advantageous for thermal loss of the switch Ysp and the generation of the sustain pulse due to the conduction of the current, because of the current path change by removing the switch.

Also, it is possible to form a more desirable scan pulse waveform because the switch Yfr performs the ground bias in the scan period by changing the current path after removing the switch.

What is claimed is:

1. A scan electrode driving apparatus for a plasma display panel (PDP) including a plurality of address electrodes and a plurality of scan electrodes and sustain electrodes alternately arranged to form a pair with each other, and having a panel capacitor between the scan electrodes and the sustain electrodes, comprising:

a power recovery unit that supplies power to apply waveforms for sustain-discharge, and recovers and reuses the power;

a ramp waveform applier that supplies a reset pulse signal for resetting each discharge cell using the power received from the power recovery unit during a reset period; and a scan pulse generator, wherein the scan pulse generator and the ramp waveform applier operate to supply a pulse signal for accumulating wall charges into addressed discharge cells during a scan period, wherein the ramp waveform applier separates a first current transmission path for transmitting the reset pulse signal from a second current transmission path for recovering the power from the panel capacitor.

2. The apparatus of claim 1, wherein the ramp waveform applier comprises a first diode for intercepting the current path recovered from the panel capacitor.

3. The apparatus of claim 2, wherein the scan pulse generator comprises a first switch connected between a terminal for supplying scan pulse waveforms and the first diode, for setting the second current path recovered from the panel capacitor.

4. The apparatus of claim 3, wherein the first switch is turned off during a ramp waveform rising period of the reset period, and is turned off during the scan period to thus let a scan pulse signal be applied to the driving circuit.

5. The apparatus of claim 2, wherein the ramp waveform applier comprises a second switch connected between the first diode and the ground voltage, for supplying the ground voltage corresponding to the voltage supplied by the scan pulse generator.

6. The apparatus of claim 5, wherein the second switch is turned on during a ramp waveform falling period of the reset period and the scan period to thus apply the ground voltage during the scan period.

7. A method for driving a plasma display panel (PDP) comprising a plurality of address electrodes and a plurality of scan electrodes and sustain electrodes alternately arranged to form a pair with each other, and having a panel capacitor between the scan electrodes and the sustain electrodes, comprising the steps of:

(a) resetting each of discharge cells defined by the address electrodes, the scan electrodes, and the sustain electrodes;

(b) addressing the discharge cells to be turned on; and (c) keeping sustain-discharge in the addressed discharge cells, wherein step (a) further comprises steps of:

supplying a reset voltage to the panel capacitor; and conducting first and second switches electrically coupled to the panel capacitor through first and second paths different from the path through which the reset voltage is supplied to the panel capacitor to thus reduce the reset voltage supplied to the panel capacitor, wherein the step (b) further comprises conducting the second switch having a second terminal coupled to the ground voltage to thus address the discharge cells.

8. The method of claim 7, wherein the step (c) further comprises the step of conducting the first switch having a second terminal electrically coupled to the sustain-discharge voltage to thus sustain-discharge the addressed discharge cells.

9. The method of claim 7, wherein, in the step (b), a scan voltage bias of a first voltage level is applied to the high side of an operation voltage and a ground voltage bias is applied to the low side of the operation voltage while the second switch is driven.

10. A scan electrode driver of an AC PDP (plasma display panel) including a plurality of scan electrodes and common electrodes, comprising:

a first switch having a first terminal coupled to a first power source for supplying a first voltage;

a first path coupled between a second terminal of the first switch and the scan electrode;

a second switch coupled between the scan electrode and the second terminal of the first switch through a second path which is different from the first path; and a ramp voltage supply including a third switch coupled to the first path and increasing a voltage at the scan electrode in a ramp format, wherein the third switch is turned on to increase the voltage at the scan electrode to a second voltage and the second switch is turned on to decrease the voltage at the scan electrode to the first voltage through the first switch while the first switch is turned on to supply the first voltage to the scan electrode.

11. The scan electrode driver of claim 10, wherein the ramp voltage supply further comprises a capacitor having a first terminal coupled to the second terminal of the first switch and storing a voltage which substantially corresponds to the difference of between the second voltage and the first voltage, and the third switch is coupled between a second terminal of the capacitor and the scan electrode.

12. The scan electrode driver of claim 11, wherein the first path further comprises a first diode having an anode coupled to the first terminal of the capacitor and a cathode coupled to the third switch.

13. The scan electrode driver of claim 10, further comprising a fourth switch, coupled to the first path, for gradually reducing the voltage at the scan electrode to a third voltage from the first voltage.

14. The scan electrode driver of claim 10, further comprising a scan buffer for applying a scan signal to the scan electrode during an address period, wherein the first path is coupled to the scan electrode through a first terminal of the scan buffer, and the second path is coupled to the scan electrode through a second terminal of the scan buffer.

15. The scan electrode driver of claim 10, further comprising a fourth switch coupled between the second terminal of the first switch and a second power source for supplying a third voltage, and the first switch is turned on to apply the first voltage to the scan electrode through the first path and the fourth switch is turned on to apply a fourth voltage to the scan electrode through the second path during a sustain period.

* * * * *